US010669899B2

(12) United States Patent
Cecur

(10) Patent No.: US 10,669,899 B2
(45) Date of Patent: Jun. 2, 2020

(54) ARRANGEMENT FOR A VALVE TRAIN ASSEMBLY

(71) Applicant: EATON SRL, Milan (IT)

(72) Inventor: Majo Cecur, Rivarolo Canavese (IT)

(73) Assignee: EATON INTELLIGENT POWER LIMITED, Dublin (IE)

( * ) Notice: Subject to any disclaimer, the term of this patent is extended or adjusted under 35 U.S.C. 154(b) by 118 days.

(21) Appl. No.: 15/744,068

(22) PCT Filed: Jul. 16, 2015

(86) PCT No.: PCT/EP2015/066243
§ 371 (c)(1),
(2) Date: Jan. 12, 2018

(87) PCT Pub. No.: WO2017/008857
PCT Pub. Date: Jan. 19, 2017

(65) Prior Publication Data

US 2018/0202326 A1 Jul. 19, 2018

(51) Int. Cl.
*F01L 1/18* (2006.01)
*F01L 1/24* (2006.01)
(Continued)

(52) U.S. Cl.
CPC ..... *F01L 1/181* (2013.01); *F01L 1/2411* (2013.01); *F01L 1/2416* (2013.01); *F01L 13/06* (2013.01);
(Continued)

(58) Field of Classification Search
CPC ..... F01L 1/181; F01L 1/2416; F01L 1/2411; F01L 2820/01; F01L 2105/00; F01L 2001/0535; F01L 13/06
(Continued)

(56) References Cited

U.S. PATENT DOCUMENTS 4,502,428 A * 3/1985 Paar ..... F01L 1/2411 123/90.46
4,554,895 A 11/1985 Ono
(Continued)

FOREIGN PATENT DOCUMENTS

DE 19507240 A1 9/1996
DE 102006031706 A1 * 1/2008 ..... F01L 1/2411
(Continued)

*Primary Examiner* — Patrick Hamo
*Assistant Examiner* — Wesley G Harris
(74) *Attorney, Agent, or Firm* — Leydig, Voit & Mayer, Ltd.

(57) ABSTRACT

An arrangement for a valve train assembly in an internal combustion engine includes: a valve train component having a body that defines a bore with a first bore section and a second bore section, the first bore section having a diameter that is greater than a diameter of the second bore section; and a hydraulic lash adjustor having a plunger mounted for reciprocal sliding movement in the second bore section to enable the hydraulic lash adjustor to expand and contract, the hydraulic lash adjustor further including a first chamber and a second chamber. The first chamber is at least partly in the first bore section and can hold hydraulic fluid for flowing into the second chamber through a valve in response to the hydraulic lash adjustor expanding.

12 Claims, 5 Drawing Sheets

(51) Int. Cl.
*F01L 13/06* (2006.01)
*F01L 1/053* (2006.01)

(52) U.S. Cl.
CPC ... *F01L 2001/0535* (2013.01); *F01L 2105/00* (2013.01); *F01L 2820/01* (2013.01)

(58) Field of Classification Search
USPC ..... 123/90.46
See application file for complete search history.

(56) References Cited

U.S. PATENT DOCUMENTS 4,624,224 A 11/1986 Kodama et al.
4,677,723 A 7/1987 Greene, Sr.
4,729,350 A * 3/1988 Speil ..... F01L 1/181 123/90.55
4,924,821 A * 5/1990 Teerman ..... F01L 1/2411 123/90.22
5,584,268 A 12/1996 Natkin et al.
5,692,469 A * 12/1997 Rammer ..... F01L 13/06 123/321
5,758,613 A 6/1998 Edelmayer et al.
2011/0079195 A1* 4/2011 Dilly ..... F01L 1/24 123/321
2016/0069222 A1* 3/2016 Young ..... F01L 1/18 123/90.39

FOREIGN PATENT DOCUMENTS

EP 0736672 A2 10/1996
EP 2143895 A1 1/2010
EP 2305968 A1 4/2011
EP 2662541 A1 * 11/2013 ..... F01L 1/24
EP 2662541 A1 11/2013
JP H06241009 A 8/1994
JP H10212909 A 8/1998
WO WO-2018025149 A1 * 2/2018 ..... F01L 1/181

* cited by examiner

ARRANGEMENT FOR A VALVE TRAIN ASSEMBLY

CROSS-REFERENCE TO PRIOR APPLICATIONS

This application is a U.S. National Phase application under 35 U.S.C. § 371 of International Application No. PCT/EP2015/066243, filed on Jul. 16, 2015. The International Application was published in English on Jan. 19, 2017 as WO 2017/008857 under PCT Article 21(2).

FIELD

The present invention relates to an arrangement for a valve train assembly, and more particularly, to an arrangement having a hydraulic lash adjuster apparatus.

BACKGROUND

A typical hydraulic lash adjuster (HLA) P1 as known in the art is shown in FIG. 1. The HLA P1 comprises a first oil-containing pressure chamber P2 defined between an outer body P3 and a plunger assembly P4 slidably mounted within the outer body P3, and a spring P5 arranged to enlarge the first chamber P2 by pushing the plunger assembly P4 outwardly from the outer body P3 to extend the HLA P1 to take up slack in a valve train assembly. The plunger assembly P4 defines a second oil containing pressure chamber P6 which is in fluid communication with the engine's oil supply (not shown). An aperture P7 between the first chamber P2 and the second chamber P6 allows oil to flow from the second chamber P6 into the first chamber P2, via a one way valve P8, when the HLA P1 extends. The one way valve P8 comprises a ball P8*a* captured by a cage P8*b* and biased by a spring P8*c* to a position closing the aperture P8. As the plunger assembly P4 moves outwardly, the volume of the first chamber P2 increases and a resulting oil pressure differential across the ball P8*a* moves it against the bias of the spring P8*c*, opening the aperture P7 and enabling oil to flow from the second oil chamber P6 into the first oil chamber P2. When the plunger assembly P4 stops moving outwardly, and the oil pressure across the ball P8*a* equalises, the ball P8*a* closes the aperture P7 under the action of the spring P8*c*.

Accordingly, a typical HLA can extend to accommodate any slack in a valve train assembly, such as between a cam and a roller, but, after it is extended, the incompressible oil in the first chamber P2 provides sufficient rigid support for the HLA P1 to open a valve when, for example, a rocker arm pivots under the control of a cam (i.e. the incompressible oil prevents the plunger assembly P4 being pushed back inwardly of the outer body P3 so that the HLA P1 acts as a solid body). The oil can escape the first chamber P2 only slowly, for example, via a small annular 'leak-down' gap P9 defined by closely spaced leak down surfaces of the outer body P3 and the plunger assembly P4. This oil leakage down the leak down surfaces from the first chamber P2 allows the HLP P1 to retract again.

Typically, HLAs (such as P1) are 'standalone' devices, and are positioned between two components of the valve train. In the configuration shown in FIG. 1, HLA P1 is installed between, for example, a valve, a valve bridge that carries a pair of valves or a push rod that carries a valve illustrated schematically as P11 and a rocker arm illustrated schematically as P10 of a valve train.

In a typical arrangement, the HLA P1 is housed in an aperture of a rocker arm with the bottom of the outer body P3 extending out from that aperture.

Such an arrangement can limit the compactness of engines due to the space that the arrangement consumes. Moreover, there is typically a requirement in engine design that moving parts in an engine (for example, components such as a rocker arm containing a HLA) should not pass closer than a minimum distance (e.g. 2.5 mm) to a static part of the engine (for example, a fuel injector). In fulfilling this requirement, therefore, the space consumed by a typical HLA such as P1 (which is both a moving part and has a minimum size for a given load) can limit the overall compactness of the engine design.

There are limits on the extent to which the size of a typical HLA such as P1 can be reduced. For example, one limit on the size of a typical HLA such as P1 is due to the limits on the maximum value of the pressure that the oil in first chamber P2 should reach when in use. The pressure of the oil in the first chamber P2 is dependant, among other things, on the diameter of the plunger assembly P4. Hence for a given engine load, there is an associated minimum diameter of the plunger assembly P4 (and hence outer body P3) required so that the pressure in the first chamber P2 does not exceed the specified maximum value. For a given load, therefore, typical HLAs such as P1 have a given minimum size.

It is desirable to provide an improved apparatus for hydraulic lash adjustment, preferably one with a reduced space burden as compared to conventional HLAs such as P1.

SUMMARY

In an embodiment, the present invention provides an arrangement for a valve train assembly in an internal combustion engine, the arrangement comprising: a valve train component comprising a body that defines a bore comprising a first bore section and a second bore section, the first bore section having a diameter that is greater than a diameter of the second bore section; and a hydraulic lash adjustor comprising a plunger mounted for reciprocal sliding movement in the second bore section to enable the hydraulic lash adjustor to expand and contract, the hydraulic lash adjustor further comprising a first chamber and a second chamber, wherein the first chamber is at least partly in the first bore section and is configured to hold hydraulic fluid for flowing into the second chamber through a valve in response to the hydraulic lash adjustor expanding, and wherein at least a portion of an inner wall of the second bore section and the plunger together define a gap comprising a leak down path configured to allow hydraulic fluid to escape from the second chamber.

DETAILED DESCRIPTION

According to a first aspect of the present invention, there is provided an arrangement for a valve train assembly in an internal combustion engine, the arrangement comprising: a valve train component comprising a body that defines a bore comprising a first bore section and a second bore section, wherein the first bore section has a diameter that is greater than a diameter of the second bore section; a hydraulic lash adjustor comprising a plunger mounted for reciprocal sliding movement in the second bore section to enable the hydraulic lash adjustor to expand and contract; the hydraulic lash adjustor further comprising a first chamber and a second chamber, wherein the first chamber is at least partly in the first bore section and is for holding hydraulic fluid for flowing into the second chamber through a valve in response to the hydraulic lash adjustor expanding; and wherein at least a portion of an inner wall of the second bore section and the plunger together define a gap that acts as a leak down path to allow hydraulic fluid to escape from the second chamber.

According to a second aspect of the present invention, there is provided a method of assembling the valve train component of the first aspect, the method comprising: forming the first bore section and forming the second bore section in the body of the component; inserting the plunger into the second bore section; providing the first chamber in the first bore.

Further features and advantages of the invention will become apparent from the following description of preferred embodiments of the invention, given by way of example only, which is made with reference to the accompanying drawings.

Figure 2:
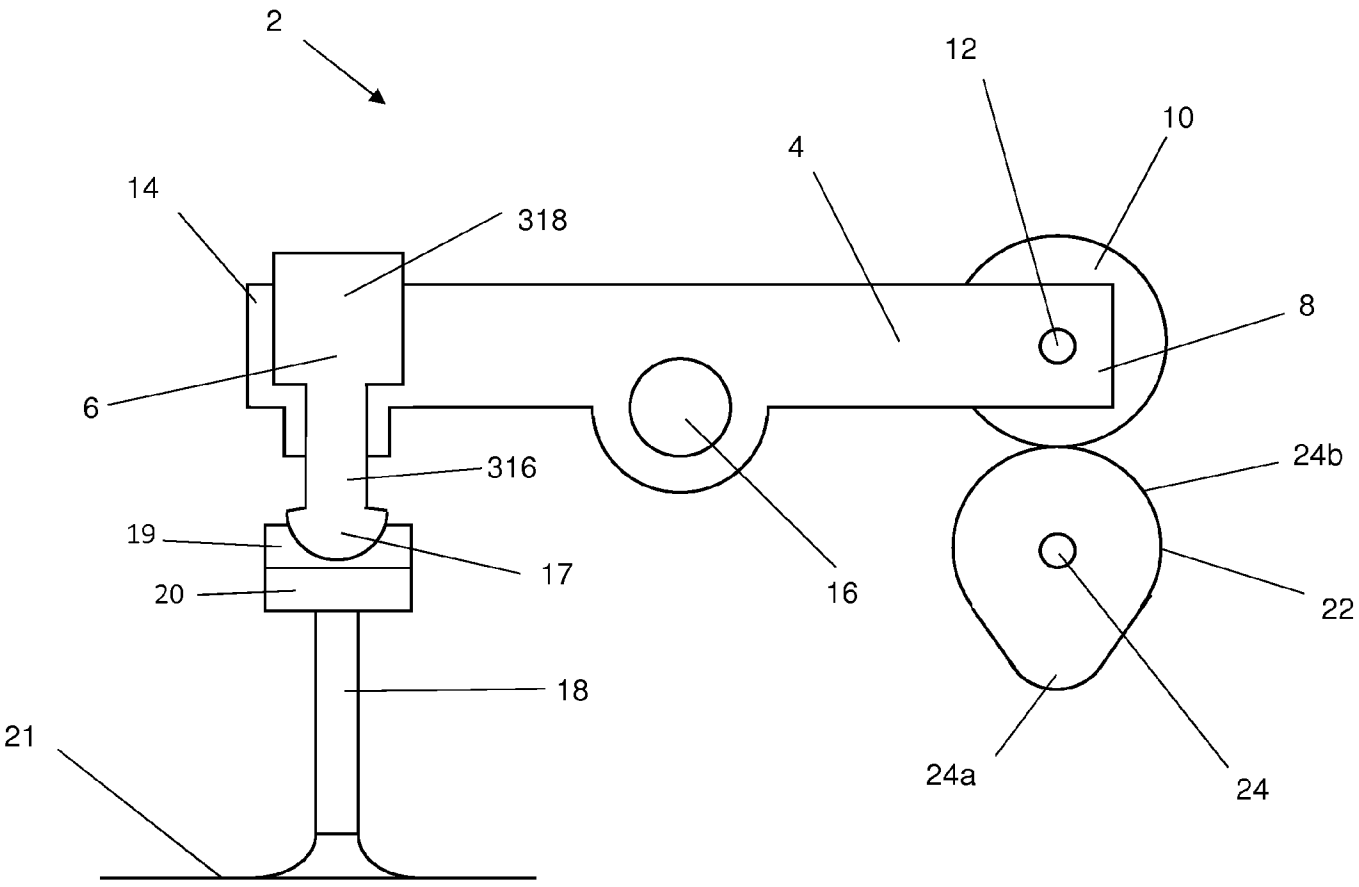
FIG. 2 illustrates schematically a side view of an exemplary valve train assembly.

FIG. 2 schematically illustrates a valve train assembly 2 comprising a rocker arm 4 according to an example embodiment of the present invention. Valve train assembly 2 may be, for example, a standard overhead cam (SOHC) valve train.

The rocker arm 4 comprises a hydraulic lash adjustment arrangement 6 at one end 14 thereof and a roller 10 rotatably mounted on an axle 12 at the other end 8 thereof. The rocker arm 4 is pivotally mounted, at around its midpoint, on a rocker arm axle 16. The hydraulic lash adjustment arrangement 6 comprises a plunger 316 and a housing 318 (to be described in more detail below). The plunger 316 comprises a part spherical end 17 for engaging a complimentary shaped socket of a so called 'Elephant' foot 19 that engages a valve carrying or engaging component 20. For example, the component 20 may be a valve bridge that carries a pair of exhaust valves 18 or a pair of inlets valves 18 of an engine cylinder 21. Alternatively, for example, the component 20 may be a push rod that engages a single exhaust valve 18 or a single inlet valve 18 of the engine cylinder 21.

A cam 22 mounted on a cam shaft 24 has a lobe 24*a* which as the cam 22 rotates with the cam shaft 24 engages the roller 10 and thus causes the rocker arm 4 to pivot counter clockwise, as shown in the drawing, about the axle 16 whereby the plunger 316 depresses the valve 18 (or valves) against the force of a valve spring to open the valve (or valves) 18. As the cam 22 continues to rotate, once the peak of the lobe 24*a* has passed out of engagement with the roller 10 the valve (or valves) 18 begins to close under the action of a valve spring(s). Once a base circle 24*b* of the cam 22 is engaged with the roller 10 the valve (or valves) 18 is fully shut.

Figure 3:
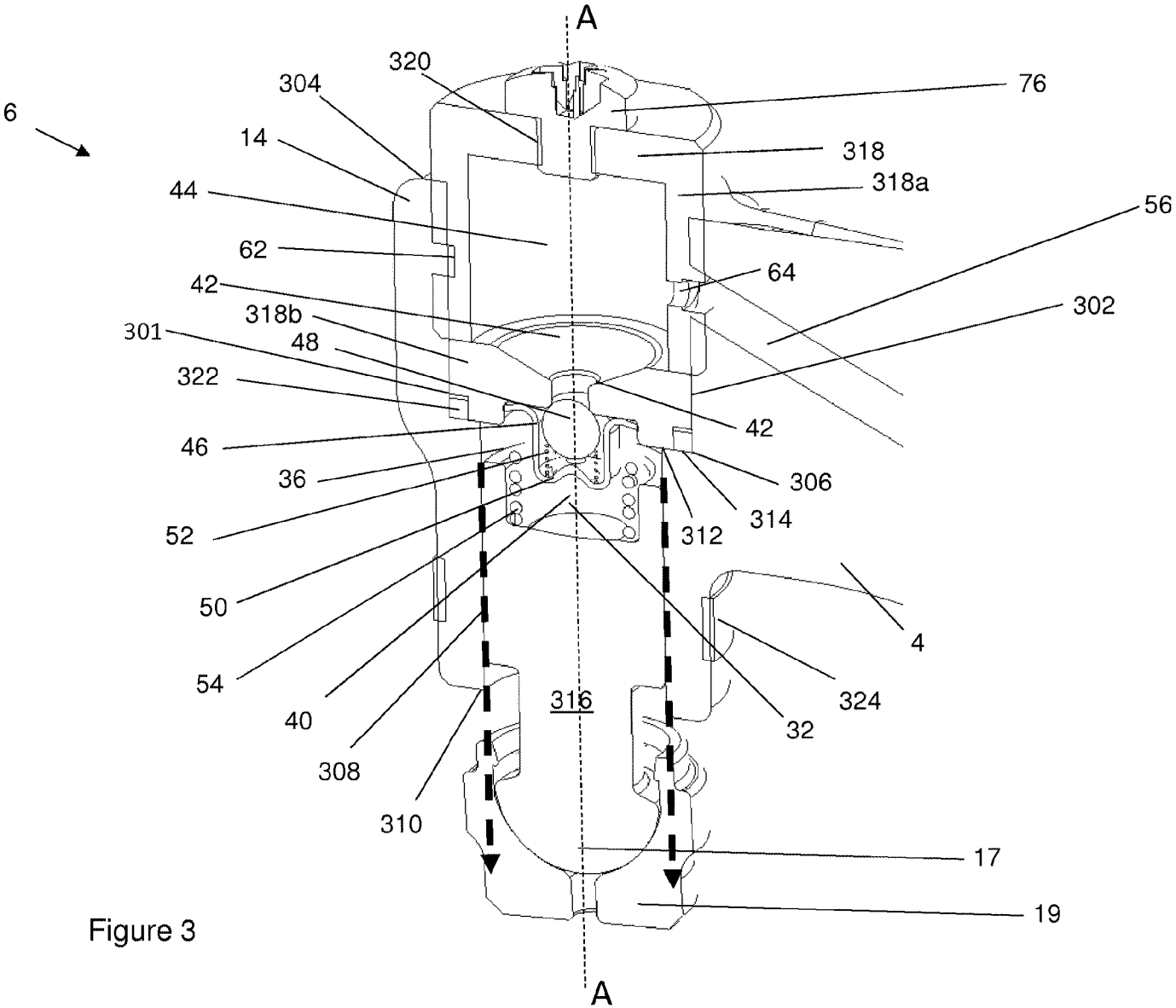
FIG. 3 illustrates a cross sectional view of an end of an exemplary rocker arm carrying a hydraulic lash adjustor arrangement.
Figure 4:
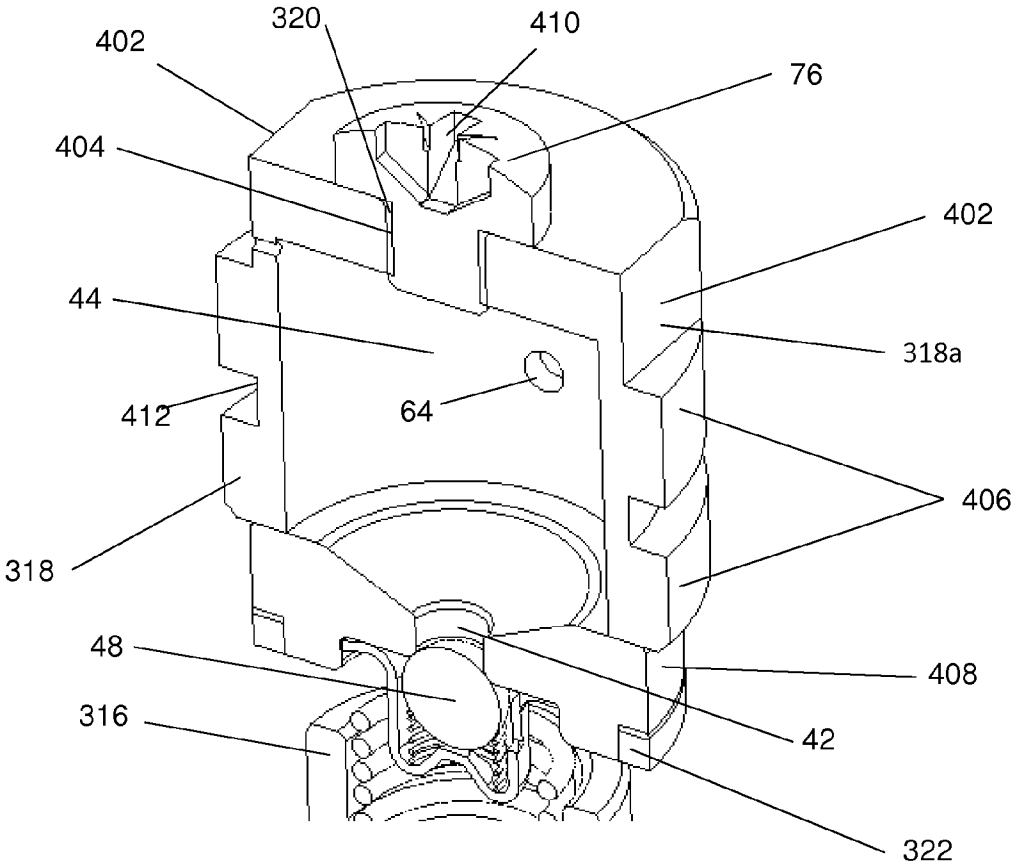
FIG. 4 illustrates a cross sectional view of components of the hydraulic lash adjustor arrangement.
Figure 5:
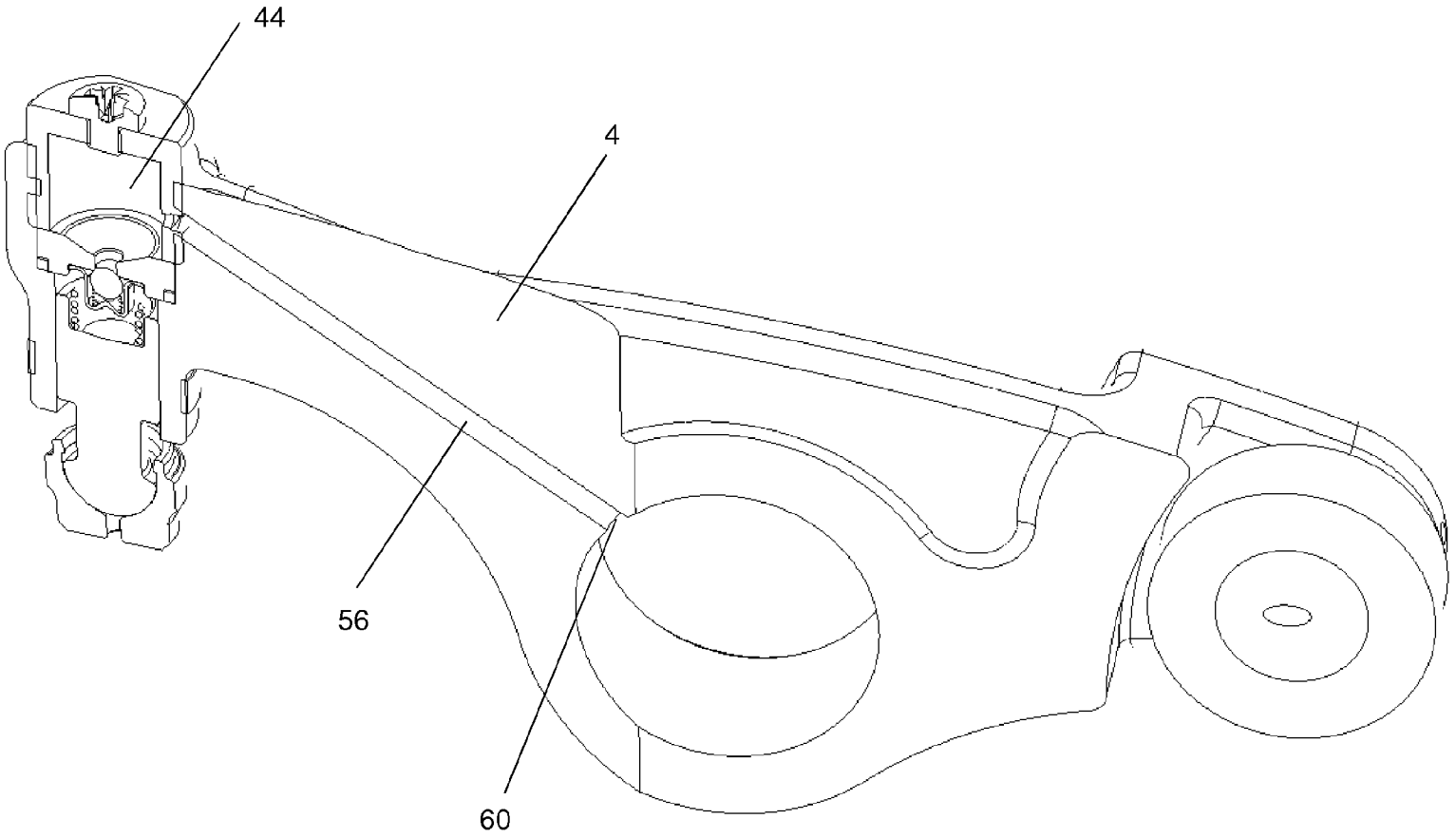
FIG. 5 shows a schematic side view of the exemplary rocker arm partially illustrated in FIG. 3.

Referring now to FIGS. 3 to 5, the rocker arm 4 defines, at the first end 14 thereof, a stepped bore 301 formed along a longitudinal axis A-A of the first end 14.

The stepped bore 301 comprises a first bore 302 and a second bore 308. The first bore 302 extends part way into the rocker arm 4 from a first surface 304 of the rocker arm 4 to first bore end 306 within the rocker arm 4. The second bore 308 extends part way into the rocker arm 4 from a second surface 310 of the rocker arm 4 to second bore end 312 within the rocker arm 4. The first surface 304 and the second surface 310 are on opposite sides of the rocker arm 4 and the first bore 302 and the second bore 308 extend into the rocker arm 4 coaxially and the first bore end 306 and the second bore end 312 are directly adjacent, i.e. they meet within the rocker arm 4 such that the end 14 of the rocker arm 4 is hollow due to bores 302 and 308.

The diameter of first bore 302 is larger than the diameter of second bore 308 such that there is a step 314 in the rocker arm 4 where the first bore end 306 meets the second bore end 312. The width of step 314 is the difference between the diameter of first bore 302 and the diameter of second bore 308. For example, if second bore 308 is a cylindrical bore with a diameter of 12 mm, and first bore 302 is a cylindrical bore with a diameter of 16 mm and is co-axial with second bore 308, then the width of step 314 is 4 mm.

The plunger 316 is mounted for sliding movement back and forth within the second bore 308 of the rocker arm 4. A first end of the plunger 316 extends outwardly of the second bore 308 of the rocker arm 4 and defines the partly spherical part 17 for engaging the foot 19. The other end of the plunger 316 defies a cylindrical recess 32.

A toroidal clip 324 encompasses the outside of the rocker arm 4 at a position corresponding to where the plunger 316 is mounted in the second bore 308 of the rocker arm 4. The toroidal clip 324 comprises a section (not visible in the figure) that extends into the second bore an can engage the plunger 316 to prevent it from sliding out of second bore 308 completely when the rocker arm is not connected in a valve train, for example during shipping of the rocker arm 4. Toroidal clip 324 may optionally be removed from rocker arm 4 after rocker arm 4 is installed in a valve train.

The housing 318 is mounted into the first bore 302 of the rocker arm 4 so as to be fixed with respect to the rocker arm 4. In this example, the housing 318 comprises a first seat part 318*a* and a second hollow cup part 318*b*. The first seat part 318*a* rests on the step of the stepped bore 301 and, in turn, the second cup part 318*b* sits on the first seat part 318*a*. At least a portion of an outer wall of the second cup part 318*b* is threaded for engagement with a reciprocal thread on the surface of the rocker arm 4 defined by first bore 302 to secure the housing 318 within the first bore 302.

The interior of the second cup part 318*b* and the first seat part 318*b* define a first oil chamber 44. The oil in the first oil chamber 44 is kept supplied from the engine's oil supply via an oil supply path at least in part defined by a conduit 56 drilled through the rocker arm 4 from an aperture 60 (see FIG. 5) through which the rocker shaft 16 (not shown in FIG. 5) extends, which conduit 56 is supplied from the engine's oil supply by a further conduit formed in the rocker shaft 16. The conduit 56 opens into a cavity 62 formed between the housing 318 and the rocker arm 4. Oil supplied via conduit 56 into the cavity 62 can flow into the first oil chamber 44 through a hole 64 formed through a side wall of the housing 318.

A sealing ring, or O-ring, 322, is positioned so as to rest against the step 314 of the rocker arm 4 defined where first bore 302 meets second bore 308. When the housing 318 is fixedly mounted in first bore 302 of rocker arm 4, the housing 318 presses hard against O-ring 322, which in turn presses hard against step 314 of rocker arm 4, and thereby creates a seal between the second bore 308 and the first bore 302 of rocker arm 4. The sealing ring 322 may be made from any suitably compressible material, for example Teflon®, which can establish an oil tight seal when compressed between step 314 and housing 318.

The cylindrical recess 32 of the plunger 316, a portion of the wall of the second bore 308 and the first seat part 318*a* define between them a second high pressure oil chamber 40. An aperture 42 defined by the first seat part 318*a* allows oil to flow from the first oil chamber 44 within the housing 318 into the second oil chamber 40 when the plunger 316 slides within bore 308 of rocker arm 4 so as to extend the HLA arrangement 6, thus enlarging the second oil chamber 40. Below the aperture 42, a ball valve 46 is provided which comprises a ball 48 captured by a cage 50 and biased by a spring 52 to a position closing the aperture 42. The plunger 316 is biased outwardly of the rocker arm 4 by means of a spring 54 held within the cylindrical recess 32 of the first oil chamber 40.

In use, the spring 54 pushes the plunger 316 outwardly of the rocker arm 4 so as to take up any slack in the valve train assembly. As the plunger 316 moves outwardly, the volume of the second chamber 40 increases and a resulting oil pressure differential across the ball 48 moves it against the bias of the spring 52, opening the aperture 42 and enabling oil to flow from the first oil chamber 44 into the second oil chamber 40. The volume of oil maintained in the first oil chamber 44 is larger than the volume of the second oil chamber 40 when the plunger 316 is outwardly extended. This ensures oil flows readily into the oil second chamber 40 whenever the plunger 316 moves outwardly. When the plunger 316 stops moving outwardly, and the oil pressure across the ball 48 equalises, the ball 48 closes the aperture 42 under the action of the spring 52. When pressure is applied as the rocker arm 4 pivots (anticlockwise in the figures), inward movement of the plunger 316 is inhibited by the high pressure of oil in the oil chamber 40. The oil in the oil second chamber 40 cannot flow back into the first oil chamber 44 because of the ball 48. However, oil can escape the second oil chamber 40 (which enables the plunger 316 to return back towards the rocker arm 4 again) by leaking between the surface of the rocker arm 4 defined by second bore 308 and the outer surface of the plunger 316. This leakage occurs only very slowly because the second bore 308 and the plunger 316 are made to tight tolerances to restrict oil flow.

Figure 1:
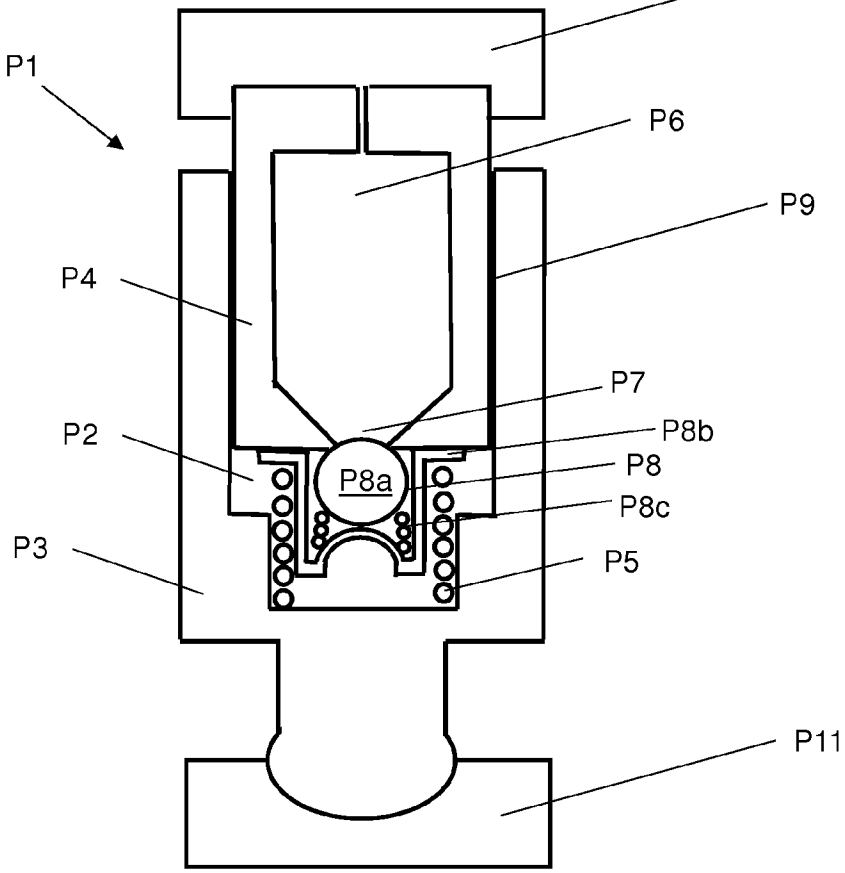
PRIOR ART Figure 1
FIG. 1 illustrates schematically a cross-sectional side view of a typical hydraulic lash adjuster as known in the art.

Advantageously, the second oil chamber 40 is formed between the plunger 316, the housing 318, and the rocker arm 4 itself. This is different to typical "standalone" HLAs such as HLA P1 shown in FIG. 1, in which the first oil-containing chamber P2 is defined between the outer body P3 and the plunger assembly P4 of the HLA P1 itself.

Moreover, the leakage of oil from the second oil chamber 40 occurs via a leak down path (indicated by the broken arrows) defined by the surface of the second bore 308 and the outer surface of the plunger 316. This is different to typical "stand-alone" HLAs such as HLA P1 shown in FIG. 1, in which oil leaks from first oil-containing chamber P2 via a gap P6 between closely spaced leak down surfaces of the outer body P3 and the plunger assembly P4. Integrating the plunger 316 and the oil housing 318 in to the rocker arm 4 itself, in effect, removes the need for the "outer body P3" as per the typical standalone HLA P1 shown in FIG. 1, and hence reduces the space burden associated therewith.

Moreover, both the housing 318 and the plunger 316 extend through and outside of the rocker arm 4 itself. This is possible since the load from the rocker arm 4 is transferred to the housing 318 via the connection (e.g. thread) of the outside of the housing 318 to the rocker arm 4. This is different from typical standalone HLAs such as P1 in FIG. 1, where the plunger assembly P4 does not extend through and beyond the rocker arm P10 because the load of the rocker arm P10 is transferred to the HLA P1 via the top of the plunger assembly P4. Integrating the plunger 316 and the housing 318 in to the rocker arm 4 itself so that both the housing 318 and the plunger 316 extend through and outside of the rocker arm 4 therefore further reduces the space burden associated with hydraulic lash adjustment as compared to the typical standalone HLA P1 shown in FIG. 1.

As most clearly seen in FIG. 4, the second cup part 318*b* of the housing 318 has an aperture 320 extending all of the way through a top portion of the second cup part 318*b*. The aperture 320 is threaded and, in use, a bolt 76 is received in the aperture 320 so as to substantially prevent oil from leaking from the first oil chamber 44.

The aperture 320 has a diameter that is large enough so that during assembly and/or testing of the hydraulic lash adjustment apparatus 6 it is possible to insert a needle, or any other suitable implement or tool through the bore 320 to repeatedly push down on and hence open the ball 48 so that oil can flow from the first chamber 44 to the second chamber 40. This procedure is known as the 'pump-up' procedure. The 'pump-up' procedure is commonly performed when testing the leakage characteristics of the hydraulic lash adjustment apparatus 6 to ensure first that the chamber 40 is suitably filled with oil. For example, the 'pump-up' procedure may be performed prior to a measurement of the so called 'leak-down time' of the hydraulic lash adjustment apparatus 6, i.e. the characteristic time taken for oil to leak from the second oil chamber 40.

Preferably, the bolt 76 has an engagement recess 410 for allowing the bolt 76 to be screwed and unscrewed from the aperture 320 using, for example a screwdriver or the like that engages with the engagement recess 410.

As mentioned above, advantageously, when in place, the bolt 76 substantially prevents oil from spilling out of the first chamber 44 through the aperture 320. Preferably, however, even when the bolt 76 is screwed tightly into the aperture 320, the bolt 76 does not form an airtight seal between the first oil chamber 44 and the outside of the first oil chamber 44 so that air can be purged from the first oil chamber 44 when the housing 318 fills with oil.

In one example, the bolt 76 does not form an airtight seal due to the small gaps 404 between the thread of the bolt 76 and the thread of the aperture 320. In an alternative example, the bolt 76 does not form an airtight seal because of one or more narrow longitudinal holes running from one end of the bolt to the other end of the bolt.

As is also best seen in FIG. 4, a threaded part of the outer wall of the second cup part 318*a* comprises two spaced apart portions 406 each of which extends around the circumference of the second cup part 318*a*.

A circumferential recess 412 is defined between the two threaded portions 406 of the housing 318 which forms conduit 62 (see FIG. 3) when the housing 318 is mounted in the rocker arm 4 and which enables oil to flow through the aperture 64 extending from the recess 412 to keep the oil in the first oil chamber 44 topped up.

The outer side wall of the second cup part 318*a* further comprises a plurality of flat portions 402 at the top end of and on opposite sides of the second cup part 318*a* for enabling a suitable tool, for example a spanner, to engage with the second cup part 318*a* so as to screw and tighten the housing 318 into the first bore 302 of the rocker arm 4. For example, the distance between the flat portions 402 may be 8 mm, in which case an M8 spanner may be used for tightening housing 318 into the bore 302 of the rocker arm 4.

As described above with reference to FIG. 3, first bore 302 of rocker arm 4 has a larger diameter than second bore 308 of rocker arm 4. As described above, this creates a step 314 in the rocker arm 4 which allows a tight seal to be created between the first bore 302 and the second bore 308 when the housing 318 is fixedly mounted in first bore 302. As a result, oil can only leak from the second oil chamber 40 via the small gap between the surface of plunger 316 and the surface of rocker arm 4 defined by second bore 308. Therefore, only the surface of the rocker arm 4 defined by second bore 308 and the surface of the plunger 316 need be manufactured as so called "leak down surfaces", i.e. surfaces manufactured to tight tolerances so as to ensure the oil leaks only slowly between them from the chamber 40.

During the manufacturing of the rocker arm 4, the stepped bore 301 is formed by forming the first bore 302 and the second bore 308 in the body of the rocker arm 4 using suitable tooling. Then, the components of the HLA arrangement are arranged in the stepped bore 301.

The first bore 302 and the second bore 308 may be formed in part by a reaming process, i.e. where a rotary cutting tool is used to enlarge the size of a previously formed hole by a small amount with high accuracy.

The leak down surface of the rocker arm 4 (i.e. the inner surface of the rocker arm defined by second bore 308) may then be formed by a honing process, i.e. where an abrasive tool is applied to the surface along a controlled path so as to smoothen said surface.

Advantageously, since the first bore 302 has a larger diameter than the second bore 308, both the reaming and the honing of the second bore 308 can be conducted with both ends of the second bore 308 being open i.e. when the honing tool is honing the second bore 308, the honing tool can extend freely into the first bore 302. As a result (as will be appreciated by those skilled in the art) the reaming and then honing of the second bore 308 of the rocker arm 4 can be conducted more reliably, more precisely, and with a more uniform and lower tool consumption as compared, for example, to reaming and then honing of a bore which is only open at one end.

Example diameters of the first and second bores (in the format 'first bore diameter in mm':'second bore diameter in mm') include 11:8.5, 12:9, 16:11, 18:12, 19:14, 21-22:16. The length of the second bore may be, for example, in the range of 80%-120% of the diameter of the second bore. For example, if the second bore diameter is 9 mm, the length of the second bore may be in the range 7.2-10.8 mm.

Further, since the first bore 302 has a larger diameter than the second bore 308, this allows the diameter of the housing 318 to be larger than the diameter of the second bore 308. In turn, this allows the diameter of the first oil chamber 44 to be relatively large, which allows a relatively large oil volume to be maintained in the first oil chamber 44.

Although in the above reference is made to "oil", this may be substituted for any suitable hydraulic fluid. Therefore, it will be appreciated that an "oil chamber" and the like as described above may be substituted for a "hydraulic fluid reservoir" and the like.

Although in the above described embodiment, the valve train component comprising the stepped bore is a rocker arm, in other examples, different valve train components may be provided with such a stepped bore containing the HLA arrangement, for example, a valve bridge, or a push rod.

The above embodiments are to be understood as illustrative examples of the invention. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. An arrangement for a valve train assembly in an internal combustion engine, the arrangement comprising:

a valve train component comprising a body that defines a bore comprising a first bore section and a second bore section, the first bore section having a diameter that is greater than a diameter of the second bore section; and a hydraulic lash adjustor comprising a plunger mounted for reciprocal sliding movement in the second bore section to enable the hydraulic lash adjustor to expand and contract, the hydraulic lash adjustor further comprising a first chamber and a second chamber, wherein the first chamber is at least partly in the first bore section and is configured to hold hydraulic fluid for flowing into the second chamber through a valve in response to the hydraulic lash adjustor expanding, wherein at least a portion of an inner wall of the second bore section and the plunger together define a gap comprising a leak down path configured to allow hydraulic fluid to escape from the second chamber, wherein the hydraulic lash adjustor comprises a first body contained in the first bore section, the first body defining the first chamber, and wherein the first body, the plunger, and the at least a portion of the inner wall of the second bore section co-operate to define the second chamber.

2. The arrangement of claim 1, wherein the hydraulic lash adjustor further comprises a first biaser arranged to bias the plunger away from the first chamber.

3. The arrangement of claim 1, wherein at least a part of an outer surface of the first body is threaded and configured to engage a complementary threaded part of an inner wall of the first bore section to fasten the first body in the first bore section.

4. The arrangement of claim 1, wherein the body of the valve train component defines an annular step of the bore, and wherein the first body abuts against the annular step.

5. The arrangement of claim 4, further comprising a sealing ring provided on the annular step that sits in an annular space defined by the body of the valve train component and the first body.

6. The arrangement of claim 1, wherein the plunger comprises a recess at one end thereof, the recess defining part of the second chamber.

7. The arrangement of claim 1, wherein the first body comprises an aperture that provides access to the first chamber, the first body further comprising a stopper inserted into the aperture, and wherein the stopper is arranged so as to substantially prevent hydraulic fluid from exiting the first chamber while allowing air to be purged from the first chamber.

8. The arrangement of claim 7, wherein the stopper comprises a threaded stem configured to engage a complementary threaded part of the first body to fasten the stopper in the aperture.

9. The arrangement of claim 1, wherein the valve train component comprises a rocker arm.

10. The arrangement of claim 9, wherein the valve train assembly comprises a valve bridge configured to carry two or more valves of an engine cylinder, and the plunger comprises an engaging portion configured to engage the valve bridge.

11. A method of assembling the valve train component of claim 1, the method comprising:

forming the first bore section and forming the second bore section in the body of the component;

inserting the plunger into the second bore section; and providing the first chamber in the first bore section.

12. The method of claim 11, wherein forming the second bore section comprises honing, using a honing tool, an inner surface of a rocker arm that defines the second bore section, and wherein when the inner surface is being honed by the honing tool, the honing tool is free to extend into the first bore section.

* * * * *